US005450297A

United States Patent [19]

Akashi et al.

[11] Patent Number: 5,450,297

[45] Date of Patent: Sep. 12, 1995

[54] REFRIGERATOR LIGHTING

[75] Inventors: Yukio Akashi; Izumi Akashi, both of Osaka, Japan

[73] Assignee: Matsushita Electric Industrial Co., Ltd., Osaka, Japan

[21] Appl. No.: 983,847

[22] PCT Filed: Jul. 8, 1992

[86] PCT No.: PCT/JP92/00876

§ 371 Date: Mar. 3, 1993

§ 102(e) Date: Mar. 3, 1993

[87] PCT Pub. No.: WO93/01460

PCT Pub. Date: Jan. 21, 1993

[30] Foreign Application Priority Data

| | | | |
|---|---|---|---|
| Jul. 9, 1991 | [JP] | Japan | 3-168147 |
| Sep. 2, 1991 | [JP] | Japan | 3-221408 |
| Apr. 9, 1992 | [JP] | Japan | 4-088527 |
| Apr. 9, 1992 | [JP] | Japan | 4-088528 |

[51] Int. Cl.[6] ..... F25D 27/00

[52] U.S. Cl. ..... 362/92; 362/94; 362/234; 362/293; 312/236

[58] Field of Search ..... 362/92, 126, 218, 234, 362/240, 294, 373, 94, 293; 312/223.5, 236

[56] References Cited

U.S. PATENT DOCUMENTS

| | | | |
|---|---|---|---|
| 3,612,848 | 10/1971 | Koch et al. | 362/92 |
| 5,034,861 | 7/1991 | Sklenak et al. | 362/92 |

FOREIGN PATENT DOCUMENTS

| | | | |
|---|---|---|---|
| 57-125993 | 8/1982 | Japan . | |
| 59-52388 | 4/1984 | Japan . | |
| 62-80196 | 5/1987 | Japan . | |
| 119029 | 6/1989 | Japan . | |
| 216235 | 5/1990 | Japan . | |
| 3241285 | 10/1991 | Japan | 362/92 |

*Primary Examiner*—Stephen F. Husar

*Attorney, Agent, or Firm*—Stevens, Davis, Miller & Mosher

[57] ABSTRACT

A refrigerator having functions to improve visibility in a space inside the refrigerator 1 and to have foods inside the refrigerator looking appetizing. Conventional refrigerators have only one, or at the most 2 lamps on an innermost wall surface of a refrigerator chamber, which makes it difficult to see foods and indications on the foods. The refrigerator of the invention overcomes this problem by providing interconnection-type lamps 6 on a front end of a refrigerator ceiling surface 4 and/or a front end of an under surface of a tray 5 over the entire width of the ceiling or the tray, and a reflection/shielding plates on front sides of the lamps 6. This arrangement offers enhanced utility of household and industrial refrigerators.

14 Claims, 2 Drawing Sheets

REFRIGERATOR LIGHTING

TECHNICAL FIELD

The present invention relates to a refrigerator having a lighting function which illuminates spaces inside a chilling chamber and a freezing chamber in the refrigerator so as to improve visibility of the contents of the refrigerator and to make the contents appetizing.

BACKGROUND ART

Hitherto, the interior of a refrigerator has been lighted with one, or two at the most, lamps or bulbs of small luminance secured to the innermost wall of the refrigerator to make the contents of the refrigerator visually recognizable.

Lighting of the interior of a refrigerator has to be made in such a way as to meet the requirements for better visibility inside the refrigerator and for improved working conditions or environment inside the refrigerator. More specifically, in regard to the first requirement, it is necessary that the lighting be done in such a way as to facilitate various kinds of work to be done in the refrigerator, e.g., finding of foods, putting foods into and out of the refrigerator, and reading of the labels on the foods, while avoiding dazzling. As to the second requirement, the lighting must be done in such a way as to give an impression that the foods as the contents of the refrigerator are colorful and appetizing, as well as an impression that the interior of the refrigerator is neat and clean. The type and location of the light source have to be selected to satisfy the above-described lighting requirements.

Conventionally, lighting inside a refrigerator relies upon a light source of a low luminance, e.g., a sewing machine lamp of 10 W or so, embedded in the innermost wall of the refrigerator, due to various restrictions in regard to arrangement of the cooling system and other components inside the refrigerator, as well as insulation of such system and components from the heat. Consequently, the known lighting system has posed problems such as dazzling, poor visibility of the foods and contents, difficulty in reading labels and giving impressions that the foods are not appetizing and the interior of the refrigerator is gloomy and dirty.

Usually, an illuminating lamp used in a refrigerator is partially or wholly made of a material having light-diffusing transmission characteristics, e.g., acrylic resin. In addition, no light is available for illuminating the inner wall surface of the refrigerator door, so that the shelves on the inner surface of the refrigerator door are completely in darkness when a room in which the refrigerator is installed is not lighted. The light from the aforesaid illuminating lamp is directed from the innermost end of the refrigerator towards the user, so that the interior of the refrigerator may be darkened when foods are disposed at such positions that they interrupt the light from the lamp. For these reasons, the users are often obliged to bring food out of the refrigerator to see it under an external lighting. Known lighting in the interior of refrigerator is not considered to enable the user to have any sense concerning the depth of-the refrigerator. In addition, the user's eyes inevitably see both the bright spot (illuminating lamp) and dark portions, so that the user tends to be dazzled and annoyed.

An object of the present invention is to ensure brightness of a level high enough to facilitate various kinds of work to be done inside a refrigerator, while avoiding dazzling of a light source and giving such impressions that the foods are colorful and appetizing and the interior of the refrigerator is neat and clean, thereby overcoming the above-described problems of the prior art.

Another object of the present invention is to make it possible to illuminate also the shelves on the inner surface of the refrigerator door, while providing lighting in good balance with the environmental brightness, thus further eliminating visual dazzling of the user.

DISCLOSURE OF THE INVENTION (1) According to the invention, there is provided a refrigerator comprising an interconnected lamp extending over the entire length, from the left to the right end, of the ceiling of the refrigerator and/or the under face of a tray in the refrigerator, and a reflective-shielding plate for reflecting and shielding the light of the interconnected lamp.

In a specific form of the invention, there is provided a refrigerator which employs an illuminating lamp the power spectrum of which is suppressed in the wavelength band of 570 to 590 nm relative to that of ordinary light.

The arrangement set forth above ensures brightness of a level high enough to facilitate various kinds of work to be done inside the refrigerator and gives impressions that the foods are fresh and appetizing and the interior of the refrigerator is clean, while avoiding dazzling.

(2) The present invention also provides a refrigerator in which illuminating lamps are provided on various surfaces including the inner wall surface of the refrigerator door, while suitably modulating the ratio of luminance between these surfaces by the lamps.

This arrangement enables the user to feel more spacious than the real space inside the refrigerator and to easily recognize the foods because the front surfaces of the foods are more sufficiently lighted than the inner wall surfaces of the refrigerator. Furthermore, the user is relieved from visual dazzling and annoyance because the light from the light source (lamp) of high luminance does not directly enter the user's eyes.

BEST MODE FOR CARRYING OUT THE INVENTION

Preferred embodiments of the present invention will be described with reference to the accompanying drawings.

(Embodiment 1)

Figure 1A:
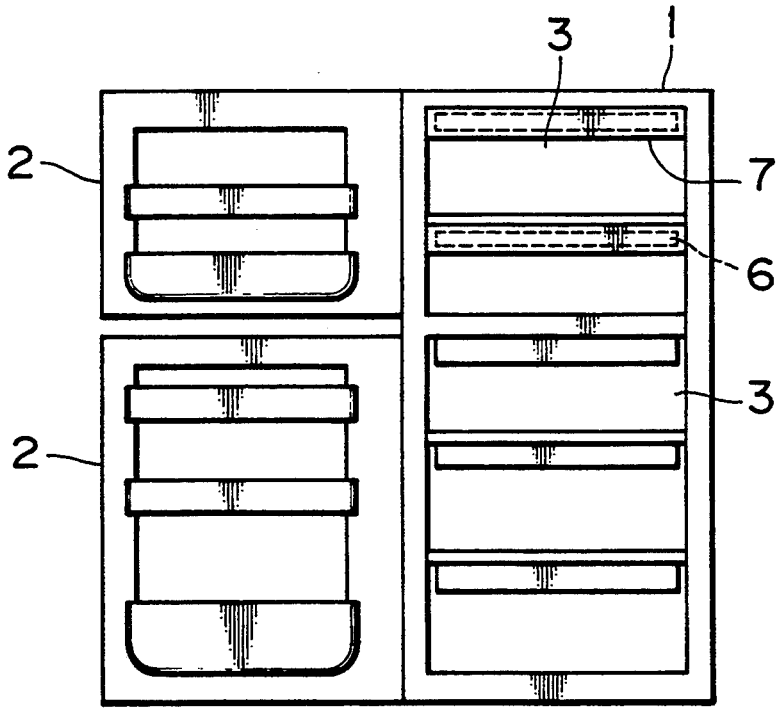
FIG. 1*a* is a schematic front elevational view of an embodiment of a refrigerator in accordance with the present invention, in a state in which a door has been opened.
Figure 1B:
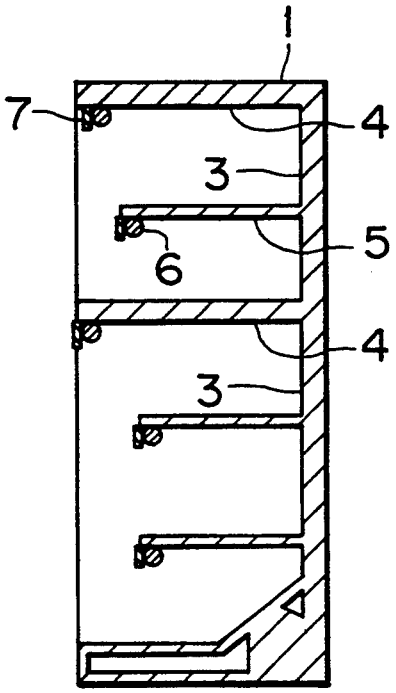
FIG. 1*b* is a schematic sectional side elevational view of the refrigerator with the door removed.

Referring to FIGS. 1*a* and 1*b*, the reference numeral 1 denotes a refrigerator, 2 denotes doors of the refrigerator, 3 denotes an innermost wall surface of the refrigerator 1, 4 denotes ceiling surfaces of the refrigerator 1, 5 denotes trays in the refrigerator 1, 6 denotes interconnection-type lamps as an illuminating light source provided on the front ends of the ceiling surfaces 4 and/or the front ends of the lower faces of the trays 5, and 7 denotes reflective-shielding plates which serve to reflect the light from the interconnected lamps 6 towards the innermost end of the refrigerator 1 while shielding the front or entrance side of the refrigerator 1 from the light of the lamps 6.

The innermost wall surface 3 and the ceiling surfaces 4 are made of a material having a high reflection/diffusion characteristic so as not to make reflect images dazzling. The interconnected lamps 6 have a length which is substantially the same as the breadth of the space inside the refrigerator 1. The reflective-shielding plates 7 provide such a shielding function as to prevent the light of the lamps 6 from being directly seen by the user. Dazzling can effectively be suppressed if the luminance of the lamps 6 through the reflecting plates 7 can be reduced to a level of 1100 cd/m$^2$ or less when the lamps 6 are turned on.

The arrangement may be such that a diffusion plate is used in place of the reflective-shielding plates 7 so as to cover the lamps 6 to provide a transmitted light. In such a case, dazzling can effectively be suppressed if the luminance of the lamps 6 through the diffusion plate 7 can be reduced to a level of 1100 cd/m$^2$ or less.

Figure 2:
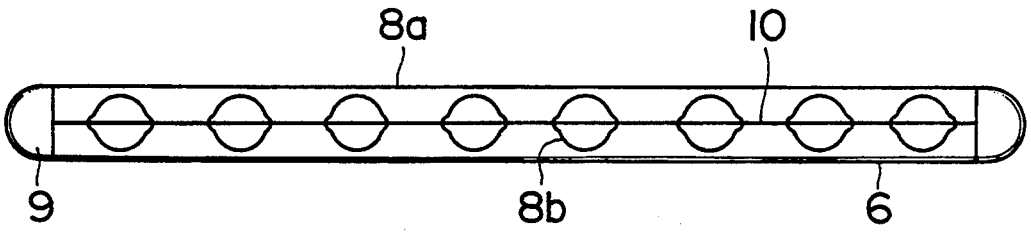
FIG. 2 is a front elevational view of an interconnected lamp used in the refrigerator.

FIG. 2 illustrates an example of the interconnected lamp 6. The lamp 6 has an outer bulb 8*a* and a plurality of inner bulbs 8*b* in the outer bulb 8*a*. The outer bulb 8*a* is hermetically closed at the opposite ends by end pieces 9. Each inner bulb 8*b* accommodates a tungsten wire 10 and the interior of the bulb 8*b* is kept under a vacuum to prevent the tungsten wire 10 from burning. Each of the inner bulbs 8*b* can be regarded as being equivalent to a single lamp bulb conventionally employed for the illumination of the refrigerator interior. Thus, the series of internal bulbs 8*b* provides the same effect as that produced when a series of independent small lamps are lit on. Connecting a multiplicity of small bulbs in series undesirably requires a large number of steps in the assembly process and is not preferred from the view point of safety. In contrast, the interconnected lamp 6 used in the present invention, however, can be installed in a single step. In addition, by varying the nature of the outer bulb 8, it is possible to obtain the same effect as that produced when a multiplicity of light sources are changed at once. When it is desirable to give an impression that the foods and food materials inside the refrigerator 1 are appetizing, it is preferred to use, as the outer bulb 8*a*, a bulb which absorbs power spectrum of a wavelength in the region of 570 to 590 nm. An evaluating experiment has been conducted by employing lamps having bulbs which absorb power spectrum of a wavelength in various wavelength regions to confirm that it is most effective to improve deliciousness of foods that the light component of wavelength region of 570 to 590 nm is reduced by absorption to a level lower than that in ordinary lamps.

A description will now be given of the functions of the illustrated embodiment of the refrigerator in accordance with the present invention. The light emitted from the interconnected lamps 6 is reflected by the reflective-shielding plate 7 towards the innermost end of the refrigerator 1, so that the user is not dazzled because the light from the lamps 6 is not directly seen by the user. The interconnected lamp 6 is a continuous linear lamp which extends from one end to the other in the space inside the refrigerator 1, so that it provides greater light diffusion and uniformity of light distribution, thus avoiding local shading by foods or user's hands, thus realizing better illuminating conditions with improved visibility as compared with the conventionally-used point source.

The interconnected lamp 6 constitutes an interconnection-type light source to enhance luster and shine of the foods and food materials such as meats and vegetables to make them more appetizing. In particular, food looks highly attractive and appetizing when lamps capable of absorbing power spectrum of 570 to 590 nm are used as the outer bulbs 8*a* of the interconnection-type lamps 6. The interconnection-type lamps 6 are preferably installed on the front sides of the ceilings 4 and/or the front ends of the under surfaces of the trays 5 as shown in FIG. 1, so that the positional relationship between the food and the light sources is not such as to cause a phenomenon called as "silhouette phenomenon" in the field of photography, thus facilitating seeing the food while avoiding dazzling by the light sources.

Thus, the illustrated embodiment makes it possible to improve visibility of the contents in the chilling chamber or freezing chamber in a refrigerator and to have the food looking more appetizing.

(Embodiment 2)

Figure 3:
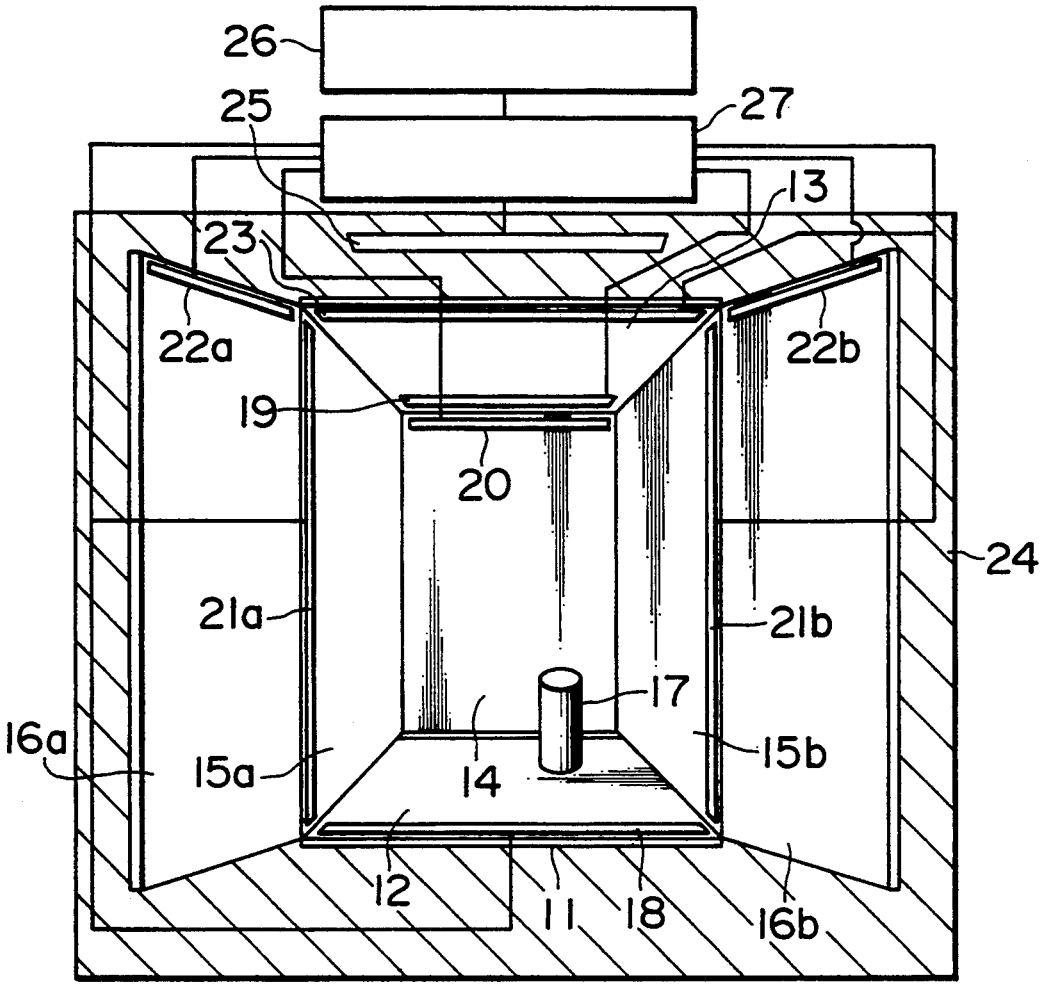
FIG. 3 is a schematic front elevational view of an essential portion of another embodiment of a refrigerator in accordance with the present invention, in a state in which a door has been opened.

FIG. 3 is a schematic front elevational view of another preferred embodiment of the refrigerator in accordance with the present invention with both refrigerator doors opened, showing also an electric circuit. In the drawing, the reference numeral 11 denotes a refrigerator, 12 denotes a floor surface of the refrigerator 11; 13 denotes a ceiling surface; 14 denotes an innermost wall surface; 15*a*, 15*b* denote surfaces of both side walls; 16*a*, 16*b* denote inner surfaces of the refrigerator 11 doors; 17 denotes food to be chilled in the refrigerator 11; 18 denotes an illuminating lamp which is disposed on the front end of the floor surface 12 so as to extend from the right to the left; 19 denotes an illuminating lamp secured to the innermost end of the ceiling surface 13 so as to extend from the right to the left; 20 denotes an illuminating lamp secured to an upper portion of the innermost wall surface 14 to extend from the right to the left; 21*a*, 21*b* denote illuminating lamps disposed vertically on the front ends of the side wall surfaces 15*a*, 15*b*; 22*a*, 22*b* denote illuminating lamps secured to upper portions of the door inner surfaces 16*a*, 16*b* so as to extend in the widthwise direction of the door; 23 denotes an illuminating lamp secured to the front end of the ceiling surface 13 so as to illuminate foods 17; 24 denotes a background surface of the refrigerator 11; 25 denotes an illuminating lamp disposed externally of the refrigerator 11 and illuminating the background surface 24 of the refrigerator 11; 26 denotes a power supply for the lamps mentioned above; and 27 denotes a light control which is interconnected between the power supply 26 and the respective illuminating lamps.

The refrigerator floor surface 12, the refrigerator ceiling surface 13, the refrigerator innermost wall surface 14, the refrigerator side wall surfaces 15*a*, 15*b* and the inner surfaces 16*a*, 16*b* of the refrigerator door define a cubic or three-dimensional internal space of the refrigerator 11. The refrigerator 11 may have a single door and hence a single inner surface of refrigerator door. As explained above, the lighting control 27 is connected between the illuminating lamps 18, 19, 20, 21*a*, 21*b*, 22*a*, 22*b*, 23 and 25 and the power supply 26 to effect lighting and control of the respective illuminating lamps independently. The illuminating lamp 18 uniformly illuminates the refrigerator floor surface 12. The illuminating lamp 19 uniformly illuminates the refrigerator ceiling surface 13. The illuminating lamp 20 uniformly illuminates the refrigerator inner wall surface 14. Similarly, the illuminating lamps 21*a*, 21*b*; 22*a*, 22*b*; and 25 uniformly illuminate the inner side wall surfaces 15*a*, 15*b*, the inner wall surfaces 16*a*, 16*b* of the refrigerator doors, and the back side 24 of the refrigerator, respectively.

In order to clarify the relationships between the luminance at various points in the refrigerator and an impression of a spaciousness inside the refrigerator, a subjective evaluation experiment with respect to a space sense inside the refrigerator was conducted by independently varying the luminance on the background surface 24 and the luminance on the refrigerator floor surface 12, the refrigerator ceiling surface 13, the refrigerator innermost wall surface 14, the inner side wall surfaces 15*a*, 15*b*, the inner surfaces 16*a*, 16*b* of the refrigerator doors, respectively.

More specifically, the experiment was conducted under five different illuminating conditions, in which a ratio $L_1/L_2$ assumed 1/1, 2/1, 3/1, 4/1 and 5/1, where $L_1$ represents the luminance on the refrigerator floor surface 12, refrigerator ceiling surface 13, refrigerator innermost wall surface 14, the inner side wall surfaces 15*a*, 15*b* and the inner surfaces 16*a*, 16*b* of the refrigerator doors, while $L_2$ represents the luminance on the background surface 24. The experimental result was submitted to five observers for evaluation of an impression of a spaciousness inside the refrigerator. The test was repeated three times employing five panelists As a result, it has been confirmed that an impression of a spaciousness is obtained when the ratio $(L_1/L_2)$ between the luminance $L_1$ and $L_2$ is set to be 3 or greater.

As a result of the experiment, the user who has opened the refrigerator doors can feel more spacious than the real space inside the refrigerator, when the light control 27 is so set that the ratio $L_1/L_2$, of the luminance $L_1$ of the refrigerator floor surface 12, refrigerator ceiling surface 13, refrigerator innermost wall surface 14, the inner side wall surfaces 15*a*, 15*b* and the inner surfaces 16*a*, 16*b* of the refrigerator doors to the luminance $L_2$ on the background 24 of the refrigerator is 3 or greater.

In order to find a condition of luminance distribution which makes foods in the refrigerator easy to see, a visibility evaluation experiment with respect to the interior of the refrigerator was conducted by independently varying the luminance $L_3$ on the food 17 illuminated by the illuminating lamp 23 and the luminance $L_1$ on the refrigerator floor surface 12, refrigerator ceiling surface 13, refrigerator innermost wall surface 14, the inner side wall surfaces 15*a*, 15*b*, and the inner surfaces 16*a*, 16*b* of the refrigerator doors.

More specifically, the experiment was conducted under five different illuminating conditions, in which a ratio $L_1/L_3$ assumed 1/1, 2/1, 1/3, 1/4 and 1/5, where $L_1$ represents the luminance on the refrigerator floor surface 12, refrigerator ceiling surface 13, refrigerator innermost wall surface 14, the inner side wall surfaces 15*a*, 15*b* and the inner surfaces 16*a*, 16*b* of the refrigerator doors, while $L_3$ represents the luminance $L_3$ on the food 17 illuminated by the illuminating lamp 23. Five observers participated in the experiment and the test was repeated three times.

As a result, it has been found that the front side of the food 17 is visible rather than forming a silhouette when the ratio $(L_1/L_3)$ between the luminance levels $L_1$ and $L_3$ is set to be 1/3 or smaller.

On the basis of the above-mentioned experiment, the front side of the food is visible rather than forming a silhouette, when the light control 27 is so set that the ratio $L_1/L_3$, of the luminance $L_1$ of the refrigerator floor surface 12, refrigerator ceiling surface 13, refrigerator innermost wall surface 14, the inner side wall surfaces 15*a*, 15*b*, the inner surfaces 16*a*, 16*b* of the refrigerator doors to the luminance $L_3$ on the front side of the food illuminated by the lamp 23 is 1/3 or smaller. It has been found also that the depth of the refrigerator 11 can be sensed when the lighting control 27 is so set as to satisfy the condition of $X_1 \geqq X_2 \geqq X_3 \geqq X_4$, where $X_1$ represents the luminance of the refrigerator innermost wall surface 14, $X_2$ represents the luminance of the refrigerator floor surface 12, refrigerator ceiling surface 13 and the refrigerator sidewall inner surfaces 15*a*, 15*b*, $X_3$ represents the luminance of the refrigerator door inner surfaces 16*a*, 16*b*, and $X_4$ represents the luminance of the background surface 24.

The above-mentioned ratios $L_1/L_2$ and $L_1/L_3$ may be controlled by means other than the lighting control. For example, the lamps may be simply on-off controlled and the ratios of the luminance may be set to fall within the above-mentioned ranges, as by, for example, varying the numbers of the lamps, positions of the lamps or orientations of the lamps.

The lamps employed in this embodiment also are encased or shielded such that light from these lamps can not be directly seen by the user, and the luminance levels of the respective surfaces are set to be lower than 1100 cd/m$^2$, thereby preventing dazzling. It is also possible to use a luminescent panel such as EL panels as the refrigerator walls, instead of the illuminating lamps.

As will be understood from the foregoing description, according to the present invention, the front side of the food inside the refrigerator is made brighter than the inner wall surfaces of the refrigerator, so that the foods are clearly visible and bright. In addition, the user can feel more spacious than the real space inside the refrigerator, because the inner wall surfaces of the refrigerator is made brighter than the background of the refrigerator. In particular, the user can feel more spacious than the real space inside the refrigerator. Furthermore, dazzling and visual annoyance are avoided because light from the illuminating lamps of high luminance levels is out of the visual field of the user.

INDUSTRIAL APPLICABILITY

As will be understood from the foregoing description, the refrigerator in accordance with the present invention improves visibility inside the refrigerator owing to the provision of illuminating lamps which are brighter than those used in known refrigerators and can have foods looking delicious. In addition, the user can sense the lateral and depthwise extensions of the space inside the refrigerator, because the inner wall surfaces of the refrigerator are brighter than the background of the refrigerator. Thus, the present invention offers satisfaction to the users of household or industrial refrigerators.

We claim:

1. A refrigerator comprising: interconnection-type lamp means extending from the right to the left over the entire width of a space inside the refrigerator and provided on at least one of the front end of the ceiling or the front end of the under surface of a tray; and reflection/shielding plate means provided on the front side of said interconnection-type lamp means so as to reflect light towards the innermost end of said space while shielding the front end of the refrigerator from said light.

2. A lamp for a refrigerator, said lamp comprising:

illuminating lamp means for producing light having a power spectrum; and means for lowering said power spectrum at a wavelength region of from 570 to 590 nm.

3. A lamp for a refrigerator according to claim 2, wherein said means for lowering comprises an outer bulb which is disposed around said illuminating lamp means and which absorbs part of said light at said wavelength region.

4. A refrigerator comprising:

a refrigerator door having an inner surface;

a refrigerator compartment having a refrigerator floor surface, a refrigerator ceiling surface, an innermost wall, and refrigerator sidewall inner surfaces;

an illuminating lamp A for illuminating a whole area of said inner surface of said refrigerator door;

an illuminating lamp B for illuminating a whole area of said refrigerator floor surface;

an illuminating lamp C for illuminating a whole area of said refrigerator ceiling surface;

an illuminating lamp D for illuminating a whole area of said innermost wall of the refrigerator;

illuminating lamps E for illuminating whole areas of said refrigerator sidewall inner surfaces;

an illuminating lamp F for illuminating a background surface outside said refrigerator;

a power supply source for supplying electrical power to said illuminating lamps A to F; and a lighting control connected between said illuminating lamps A to F and said power supply source;

wherein, when the refrigerator door has been opened, said illuminating lamps provide such illumination that a ratio ($L_1/L_2$) of luminance $L_1$ of a region defined by the refrigerator door inner surface, refrigerator floor surface, refrigerator ceiling surface and the refrigerator side wall inner surfaces to luminance $L_2$ of said background surface is 3 or greater.

5. A refrigerator according to claim 4, wherein said illuminating lamps A to E provide such illumination as to meet a condition of $X_1 \geqq X_2 \geqq X_3 \geqq X_4$, where $X_1$ represents luminance of the refrigerator innermost wall surface, $X_2$ represents luminance of the refrigerator floor surface, refrigerator ceiling surface and the refrigerator sidewall inner surfaces, $X_3$ represents luminance of the refrigerator door inner surface, and $X_4$ represents luminance of the background surface.

6. A refrigerator according to claim 4, wherein, when said illuminating lamps are turned on, luminance levels of the refrigerator door inner surface, refrigerator floor surface, refrigerator ceiling surface, refrigerator innermost wall surface, refrigerator side wall inner surfaces and the refrigerator background surface are lower than 1100 cd/m$^2$.

7. A refrigerator according to claim 4, wherein light-emitting portions of all said illuminating lamps except for said illuminating lamp F are hidden outside a visible field of the user.

8. A refrigerator according to claim 5, wherein light-emitting portions of all said illuminating lamps except for said illuminating lamp F are hidden outside a visible field of the user.

9. A refrigerator comprising:

at least one refrigerator tray;

at least one refrigerator door; and an illuminating lamp provided on each said at least one refrigerator tray so as to illuminate a front side of food lying on said each of said at least one refrigerator tray at least from the front end of said each of said at least one refrigerator tray;

wherein said illuminating lamps provide such illumination that a ratio ($L_1/L_3$) of luminance $L_1$ of a region defined by a refrigerator door inner surface, refrigerator floor surface, refrigerator ceiling surface and refrigerator side wall inner surfaces to luminance $L_3$ of the front side of said food lying on said each of said at least one refrigerator tray is 1/3 or smaller when the at least one refrigerator door has been opened.

10. A refrigerator comprising:

at least one refrigerator door having an inner surface;

a refrigerator compartment having a refrigerator floor surface, a refrigerator ceiling surface, an innermost wall, and refrigerator sidewall inner surfaces;

at least one refrigerator tray;

an illuminating lamp A for illuminating a whole area of said inner surface of said at least one refrigerator door;

an illuminating lamp B for illuminating a whole area of said refrigerator floor surface;

an illuminating lamp C for illuminating a whole area of said refrigerator ceiling surface;

an illuminating lamp D for illuminating a whole area of said innermost wall of the refrigerator;

illuminating lamps E for illuminating whole areas of said refrigerator sidewall inner surfaces;

an illuminating lamp F for illuminating a background surface outside said refrigerator; and an illuminating lamp G provided on each of said at least one refrigerator tray for illuminating a front side of food lying on said each of said at least one refrigerator tray at least from the front end of said each of said at least one refrigerator tray;

wherein said illuminating lamps provide such illumination that a ratio ($L_1/L_3$) of luminance $L_1$ of a region defined by the inner surface of said at least one refrigerator door, refrigerator floor surface, refrigerator ceiling surface and the refrigerator side wall inner surfaces to luminance $L_3$ of the front side of said food lying on said each of said at least one refrigerator tray is 1/3 or smaller when the at least one refrigerator door has been opened.

11. A refrigerator according to claim 10, wherein said illuminating lamps A to E provide such illumination as to meet a condition of $X_1 \geqq X_2 \geqq X_3 \geqq X_4$, where $X_1$ represents luminance of the refrigerator innermost wall surface, $X_2$ represents luminance of the refrigerator floor surface, refrigerator ceiling surface and the refrigerator sidewall inner surfaces, $X_3$ represents luminance of the refrigerator door inner surface, and $X_4$ represents luminance of the background surface.

12. A refrigerator according to claim 10, wherein, when said each illuminating lamps is lit on, luminance levels of the refrigerator door inner surface, refrigerator floor surface, refrigerator ceiling surface, refrigerator innermost wall surface, refrigerator side wall inner surfaces and the refrigerator background surface are lower than 1100 cd/m$^2$.

13. A refrigerator according to claim 10, wherein light-emitting portions of all said illuminating lamps except for said illuminating lamp F are hidden outside the visible field of the user.

14. A refrigerator according to claim 11, wherein light-emitting portions of all said illuminating lamps except for said illuminating lamp F are hidden outside the visible field of the user.

* * * * *